US005456505A

United States Patent [19]

Yamada

[11] Patent Number: 5,456,505

[45] Date of Patent: Oct. 10, 1995

[54] HERMETICALLY-SEALED HANDLE ASSEMBLY

[75] Inventor: Kenichi Yamada, Tokyo, Japan

[73] Assignee: Takigen Manufacturing Co. Ltd., Tokyo, Japan

[21] Appl. No.: 191,813

[22] Filed: Feb. 3, 1994

[30] Foreign Application Priority Data

Feb. 24, 1993 [JP] Japan ..... 5-012367 U

[51] Int. Cl.[6] ..... E05C 3/04

[52] U.S. Cl. ..... 292/202; 292/DIG. 71; 292/336.3

[58] Field of Search ..... 292/202–204, 292/336.3, 347–351, 354, DIG. 12, 27, 53, 54, 56, 57, 60, 64, 71, 73; 70/207, 209, 210, 463, DIG. 31; 411/167, 368–370, 373, 374, 534, 542, 955, 959, 960, 924, 934, 940, 941, 998

[56] References Cited

U.S. PATENT DOCUMENTS

| | | | |
|---|---|---|---|
| 1,648,289 | 11/1927 | Winters et al. | 292/DIG. 71 X |
| 1,722,583 | 7/1929 | Kosten | 292/DIG. 71 X |
| 2,043,418 | 6/1936 | Newmark | 292/348 X |
| 2,310,348 | 2/1943 | Blears | 292/202 |
| 2,638,771 | 5/1953 | Comey et al. | 70/107 X |
| 3,301,580 | 1/1967 | Greitzer | 292/351 |
| 3,347,580 | 10/1967 | Whiting | 292/DIG. 71 X |
| 3,382,630 | 5/1968 | Chivers | 411/537 X |
| 4,006,661 | 2/1977 | Sims, Jr. | 411/959 X |
| 4,906,036 | 3/1990 | James | 292/202 |
| 5,319,854 | 6/1994 | Pracht | 411/369 X |

FOREIGN PATENT DOCUMENTS

| | | | |
|---|---|---|---|
| 1562269 | 4/1969 | France | 411/369 |
| 63-10177 | 1/1988 | Japan . | |
| 268951 | 4/1927 | United Kingdom | 292/349 |

*Primary Examiner*—Peter M. Cuomo
*Assistant Examiner*—Suzanne L. Dino
*Attorney, Agent, or Firm*—Martin Smolowitz

[57] ABSTRACT

A hermetically-sealed handle assembly is disclosed. The assembly cuts labor costs and improves the productivity in manufacturing. A back plate 1 has a hole 4 in its central portion, in which 4 a head 3 of a pivot bolt 2 is inserted in a non-rotatable manner. A base plate 5 has a through-hole 7 for receiving therein a threaded shaft 6 of the bolt 2, and is provided with a hole 8 having its hole edge 8*a* subjected to a burring operation through which the hole edge 8*a* is passed through a through-hole 24 of the back plate 1 and turned outward behind the plate 1 to have it fixed to the base plate 5. A handle 9 has an axial hole 10 for receiving the threaded shaft 6 therein. A cap nut 11 is threadably engaged with a front end of the bolt 2 through a washer 12. A screw 14 threadably engages with a radial hole 13 of the nut 11, the screw 14 having its front end intensely abutted against a side surface of the threaded shaft 6.

2 Claims, 2 Drawing Sheets

HERMETICALLY-SEALED HANDLE ASSEMBLY

BACKGROUND OF THE INVENTION

1. Field of the Invention

The present invention relates to a hermetically-sealed handle assembly for hermetically locking a door to a stationary frame element of a refrigerator and the like.

2. Description of the Prior Art

In a conventional hermetically-sealed handle assembly, a pivot bolt, which permits a handle piece to be rotatably mounted on a base plate, is fixedly mounted on the base plate by welding. The pivot bolt has its threaded shaft portion inserted in an axial hole of the handle piece and has its front end threadably engaged with a cap nut. In another conventional handle assembly such as disclosed in Japanese Utility Model Laid-Open No. Sho 63-10177, the nut is fixed to the base plate by welding. On the other hand, the pivot bolt has its threaded shaft portion inserted in the axial hole of the handle piece, and has a front end of its threaded shaft portion engaged with the nut.

However, in such conventional type of the handle assembly in which the pivot bolt and the nut are fixed to the base plate by welding, it is necessary to perform such welding by skilled workers, which increases labor costs. Since the manually-performed welding operation is poor in workability, the conventional handle assembly is poor in its productivity.

SUMMARY OF THE INVENTION

It is an object of the present invention to provide a hermetically-sealed handle assembly which may cut labor costs and improve the productivity of the assembly.

The above object of the present invention is accomplished by providing:

a swingable handle assembly comprising:

a back plate provided with a receiving hole in its central portion, in which hole a head portion of a pivot bolt is inserted in a non-rotatable manner, the back plate being provided with a through-hole in its corner portion;

a flat-box type base plate which receives therein the back plate, and is provided in its central portion with a through-hole for receiving therein a threaded shaft portion of the pivot bolt while provided in its corner portion with a mounting hole corresponding to the through-hole of the back plate, the mounting hole having its hole edge portion subjected to a burring operation through which the hole edge portion is passed through the through-hole of the back plate and turned or bent outward behind the back plate to have the same fixed to the base plate;

a handle piece provided with an axial hole in which the threaded shaft portion of the pivot bolt is inserted;

a cap nut threadably engaged with a front-end portion of the pivot bolt;

a plurality of plastic washers each of which is interposed between the base plate and the handle piece, and between the handle piece and the cap nut; and a screw threadably engaged with a radial threaded hole of the cap nut, the screw having its front end intensely abutted against a side surface of the threaded shaft portion of the pivot bolt.

DESCRIPTION OF THE PREFERRED EMBODIMENTS

Figure 1:
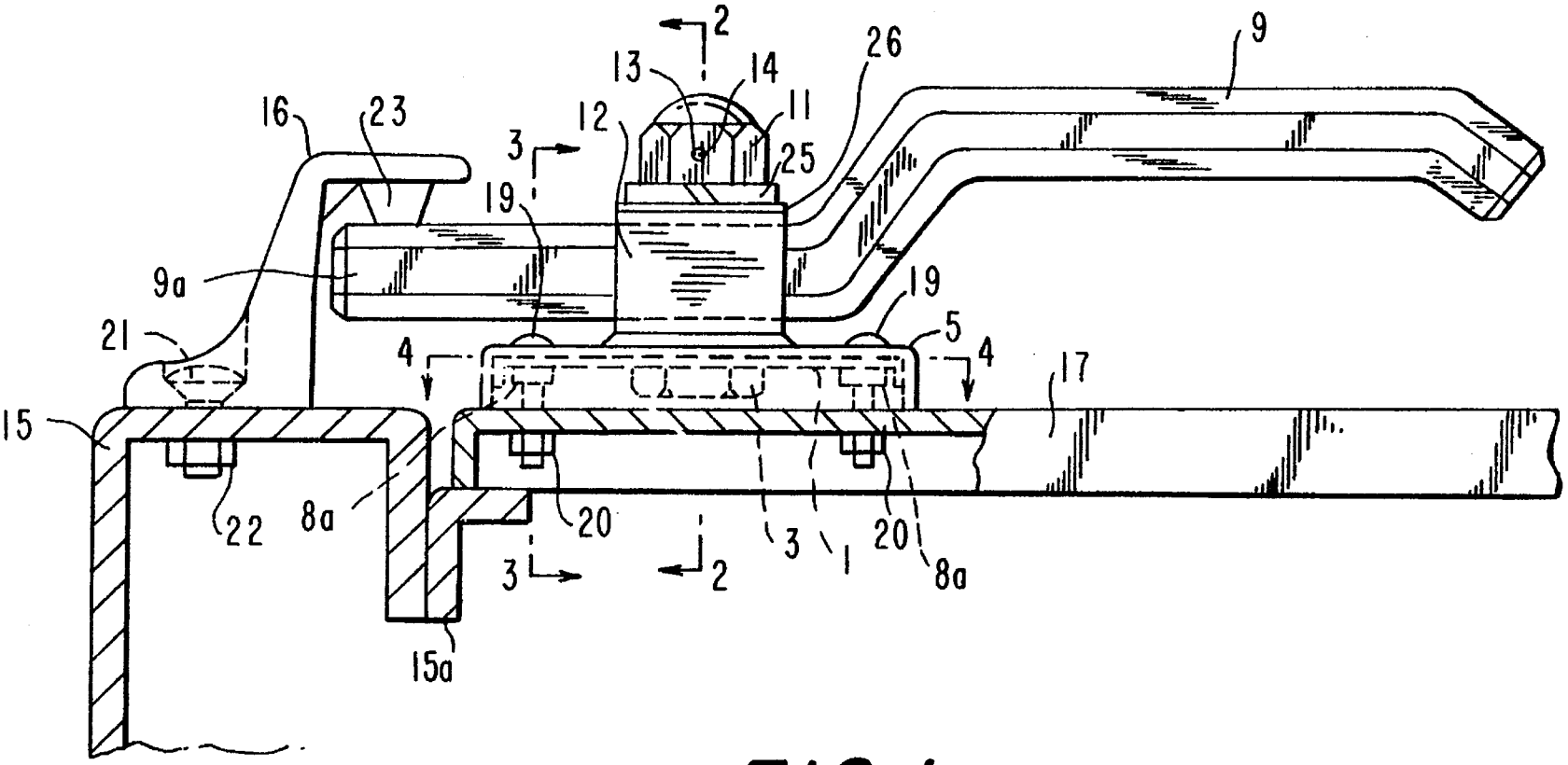
FIG. 1 is a bottom view of an embodiment of the hermetically-sealed handle assembly of the present invention in its locked position.
Figure 2:
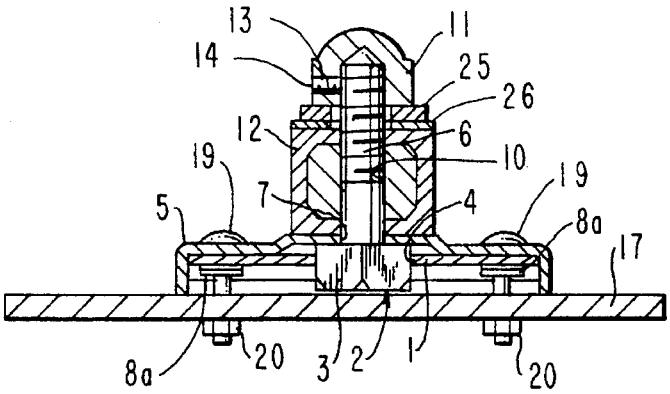
FIG. 2 is a cross-sectional view of the hermetically-sealed handle assembly of the present invention, taken along the line 2—2 of FIG. 1.
Figure 3:
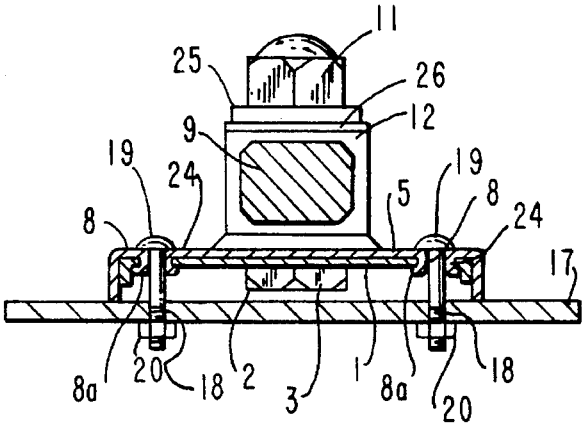
FIG. 3 is a cross-sectional view of the hermetically-sealed handle assembly of the present invention, taken along the line 3—3 of FIG. 1.
Figure 4:
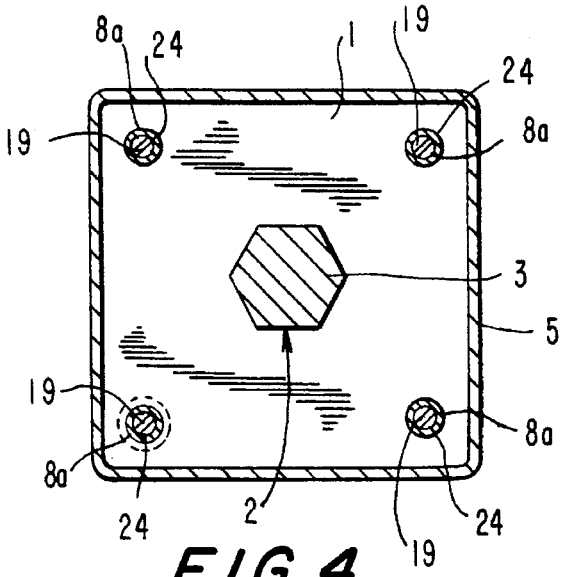
FIG. 4 is a cross-sectional view of the hermetically-sealed handle assembly of the present invention, taken along the line 4—4 of FIG. 1.

Hereinbelow, the present invention will be described in detail with reference to the accompanying drawings and the reference numerals and characters.

In a hermetically-sealed handle assembly of the present invention, a back plate 1 is provided with a hexagonal receiving hole 4 in its central portion, in which hole 4 a hexagon head portion 3 of a pivot bolt 2 is inserted in a non-rotatable manner. The back plate 1 is provided with a through-hole 24 in each of its corner portion. A flat-box type base plate 5 receives therein the back plate 1, and is provided in its central portions with a through-hole 7 for receiving therein a threaded shaft portion 6 of the pivot bolt 2 while being provided in its corner portions with a mounting hole 8 corresponding to each of the through-holes 24 of the back plate 1.

The mounting hole 8 has its hole edge portion 8*a* subjected to a burring operation through which the hole edge portion 8*a* is passed through the through-hole 24 of the back plate 1 and turned or bent outward behind the back plate 1 to have the back plate 1 fixed to the base plate 5. A handle piece 9 is provided with an axial hole 10 in which the threaded shaft portion 6 of the pivot bolt 2 is inserted. A cap nut 11 is threadably engaged with a front-end portion of the pivot bolt 2 so as to retain the handle piece 9. A plurality of plastic washers 12, each of which is interposed between the base plate 5 and the handle piece 9 and also between the handle piece 9 and the cap nut 11, are provided in the handle assembly of the present invention. A screw 14 is threadably engaged with a radial threaded hole 13 of the cap nut 11. The screw 14 has its front end intensely abutted against a side surface of the threaded shaft portion 6 of the pivot bolt 2.

In operation, when the handle piece 9 is swung on the pivot bolt 2 to travel to a predetermined position, a front-end portion 9*a* of the handle piece 9 engages with a socket member 16 of a stationary frame element 15, so that a door 17 is locked to the stationary frame element 15. On the other hand, when the handle piece 9 is reversely swung on the pivot bolt 2 to travel from such predetermined position to its initial position, the front-end portion of the handle piece 9 is disengaged from the socket member 16 of the stationary frame element 15 so that the door 17 is unlocked from the stationary frame element 15, whereby a user can open the door 17 by pulling it forward.

In the handle assembly of the present invention, since the back plate 1 prevents the pivot bolt 2 from rotating and the screw 14 prevents the cap nut 11 from loosening, there is no fear that the pivot bolt 2 and the cap nut 11 are loosened to drop out of the assembly, even when the handle piece 9 is repeatedly swung on the pivot bolt 2 counterclockwise and clockwise for a long period of time.

In the embodiment shown in the drawings, the base plate 5 is fixedly mounted on the door 17 through four screws 19 each of which has its threaded shaft portion: pass through the mounting hole 8 of the base plate 5 and each of through-holes 18 of the door 17; and threadably engaged with each of nuts 20. The socket member 16 is fixedly mounted on the stationary frame element 15 through a pair of screws 21 and their corresponding nuts 22. The socket member 16 is provided with an abutting cam projection 23 for having the door 17 brought into a hermetic contact with the stationary frame element 15 through a packing 15*a*. Since the head 3 of the pivot bolt 2 assumes a hexagonal shape, the receiving hole 4 of the back plate 1 is also formed into a corresponding hexagonal shape.

Each of the washers 12 is made of plastics material such as "Durcon" (trade name), and formed into a sleeve-like shape surrounding the handle piece 9 on all sides. Interposed between the plastic washer 12 and the cap nut 11 are a spring washer 25 and flat washer 26. The plastic washers 12 enable the handle piece 9 to perform a noise-free smooth rotational operation. The back plate 1 not only serves as a means for preventing the pivot bolt 2 from rotating, but also serves as a means for reinforcing the base plate 5.

In the hermetically-sealed handle assembly of the present invention having the above construction: the base plate 5 is provided in each of its corner portion with a mounting hole 8 corresponding to the through-hole 24 of the back plate 1. The mounting hole 8 has its hole edge portion 8*a* subjected to a burring operation through which the hole edge portion 8*a* is passed through the through-hole 24 of the back plate 1 and turned or bent outward behind the back plate 1 so as to have the back plate 1 fixed to the base plate 5; the threaded shaft portion 6 of the pivot bolt 2 is inserted in the through-hole 7 of the central portion of the base plate 5; and, the pivot bolt 2 has its hexagonal head portion 3 inserted in the corresponding hexagonal receiving hole 4 of the central portion of the back plate 1 in a non-rotatable manner. Consequently, it is possible to fixedly mount the pivot bolt 2 on the base plate 5 through a simple press working, which makes it possible to cut labor costs and improve the productivity in manufacturing for the handle assembly.

What is claimed is:

1. A hermetically-sealed handle assembly comprising:

a back plate (1) provided with a receiving hole (4) in a central portion of the back plate, in which hole (4) a head portion (3) of a pivot bolt (2) is inserted in a non-rotatable manner, said back plate (1) being provided with a through-hole (24) in each corner portion of the back plate (1);

a flat-box type base plate (5) which receives therein said back plate (1), said base plate (5) being provided in a central portion of the back plate (5) with a through-hole (7) for receiving therein a threaded shaft portion (6) of said pivot bolt (2) while being provided in each corner portion of the base plate (5) with a mounting hole (8) corresponding to each said through-hole (24) of said back plate (1), each said mounting hole (8) having a hole edge portion (8*a*) subjected to a burring operation by which said hole edge portion (8*a*) is passed through said through-hole (24) of said back plate (1) and is turned or bent outward behind said back plate (1) so as to have the back plate (1) fixed to said base plate (5);

a handle piece (9) provided with an axial hole (10) in which said threaded shaft portion (6) of said pivot bolt (2) is inserted;

a cap nut (11) threadably engaged with a front-end portion of said pivot bolt (2) so as to retain said handle piece (9);

a plurality of plastic washers (12) each of which is interposed between said base plate (5) and said handle piece (9), and between said handle piece (9) and said cap nut (11), said washers (12) having a sleeve-like shape so as to surround a central portion of said handle piece (19);

a screw (14) threadably engaged with a radial threaded hole (13) of said cap nut (11), said screw (14) having its front end intensely abutted against a side surface of said threaded shaft portion (6) of said pivot bolt (2).

2. The handle assembly of claim 1, wherein said base plate (5) is fixedly-mounted onto a door (17) by a screw (19) extending through each said hole (24) and said handle piece (9) includes a front end portion (9*a*) which can engage with a socket member (16) of a stationary frame (15), said socket member (16) having a cam projection (23) for contacting said front end piece (9*a*) and bringing the door (17) into hermetic-seal contact with the frame (15).

* * * * *